US007359668B2

(12) United States Patent
Funabiki et al.

(10) Patent No.: US 7,359,668 B2
(45) Date of Patent: Apr. 15, 2008

(54) IMAGE FIXING DEVICE

(75) Inventors: Hiroshi Funabiki, Uenohara (JP); Yukio Okamoto, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 284 days.

(21) Appl. No.: 11/158,691

(22) Filed: Jun. 21, 2005

(65) Prior Publication Data

US 2006/0072946 A1 Apr. 6, 2006

(30) Foreign Application Priority Data

Oct. 6, 2004 (JP) ..... 2004-293477

(51) Int. Cl.
*G03G 15/20* (2006.01)

(52) U.S. Cl. ..... 399/333

(58) Field of Classification Search ..... 399/328, 399/329, 330, 333; 219/216
See application file for complete search history.

(56) References Cited

U.S. PATENT DOCUMENTS

| | | | | |
|---|---|---|---|---|
| 5,722,025 | A * | 2/1998 | Morigami et al. | 399/330 |
| 6,072,155 | A * | 6/2000 | Tomatsu | 219/216 |
| 6,704,537 | B2 * | 3/2004 | Takeuchi et al. | 399/328 |
| 7,218,884 | B2 * | 5/2007 | Miyazaki | 399/328 |
| 2004/0264991 | A1 * | 12/2004 | Yoshikawa | 399/69 |

FOREIGN PATENT DOCUMENTS

| | | | |
|---|---|---|---|
| JP | 62144187 | A * | 6/1987 |
| JP | 10301427 | A * | 11/1998 |
| JP | 11024479 | A * | 1/1999 |
| JP | 11-242403 | | 9/1999 |
| JP | 2000286034 | A * | 10/2000 |
| JP | 2001-134123 | | 5/2001 |
| JP | 2001-215833 | | 8/2001 |
| JP | 2001-265146 | | 9/2001 |
| JP | 2004-061700 | | 2/2004 |

* cited by examiner

*Primary Examiner*—Robert Beatty
(74) *Attorney, Agent, or Firm*—Squire, Sanders & Dempsey L.L.P.

(57) ABSTRACT

There is described a fixing device equipped in an image forming apparatus, which employs an electro-photographic method for forming an image on a transfer material, and having a lifetime longer than conventional one. The fixing device includes a first roller having a first elastic layer formed in a cylindrical shape on an outer surface of the first roller; and a second roller having a second elastic layer formed in a cylindrical shape on an outer surface of the second roller. A hardness of the second elastic layer is higher than that of the first elastic layer, and a nip section is formed between the first elastic layer and the second elastic layer. A longitudinal length of the first elastic layer in an axial direction of the first roller is greater than that of the second elastic layer in an axial direction of the second roller.

8 Claims, 6 Drawing Sheets

IMAGE FIXING DEVICE

This application is based on Japanese Patent Application NO. 2004-293477 filed on Oct. 6, 2004 in Japanese Patent Office, the entire content of which is hereby incorporated by reference.

BACKGROUND OF THE INVENTION

The present invention relates to an image forming apparatus, such as a copier, a printer, a facsimile, etc., and specifically relates to such an image forming apparatus that applies heat and pressure onto an unfixed toner image formed on a transfer material by means of a pair of pressing rollers so as to fix the unfixed toner image on the transfer material.

In the image forming apparatus that conducts the image forming operation by employing the electro-photographic method, the toner image formed on an image bearing member (photoreceptor drum) or an intermediate transfer member is transferred onto the transfer material (hereinafter, also referred to as a recording medium or a paper), and the toner image (unfixed toner image) residing on the transfer material is fixed by fixing unit.

The roller fixing method could be cited as a fixing method. According to the roller fixing method, the transfer material, which holds the unfixed toner image on it, is conveyed to a pressure nip section that is formed by a pair of pressing rollers, one of which press-contacts the other one incorporating a heater in it, so as to fix the unfixed toner image on the transfer material by applying heat and pressure at the pressure nip section. Further, the belt fixing method could be cited as another fixing method. According to the belt fixing method, the pressure nip section is formed by a support pressing roller, which is disposed inside a fixing belt so as to support the fixing belt, and an external pressing roller, which press-contacts the fixing belt while placing the fixing belt between the support pressing roller and the external pressing roller, so that the unfixed toner image, residing on the transfer material, faces the heated fixing belt to achieve the fixing operation.

In either the roller fixing method or the belt fixing method, the fixing operation is achieved at the pressure nip section formed by the pair of pressing rollers, which are in a state of press-contacting each other. In this operation, to improve the fixing efficiency, a pressing roller, having a rubber elastic property, is employed, since it is effective for this purpose to lengthen a length of the pressure nip section in a paper conveying direction.

With respect to the structure between the pair of pressing rollers, extensive studies have been carried out.

To prevent the transfer material from wrinkling when passing through the pressure nip section, there has been frequently proposed such a countermeasure that the shape of the pair of pressing rollers should be modified to a certain shape from the conventional cylindrical shape (for instance, set forth in Patent Documents 1-4). In any one of such the proposals, however, there are no descriptions in regard to durability and lifetime of the pressing roller. Instead, there are merely indicated in the drawings such schematic diagrams that show shapes of the pair of pressing rollers, both lengths of which are the same in a rotating-axial direction of them.

Further, with respect to the fixing roller made of a cylindrical glass base, outer surface of which is coated with the elastic layer, to relieve the stress concentration occurring at the end portion of the elastic layer and the load concentration incurred onto the glass base, Patent Document 5 sets forth such a countermeasure that the thickness of the elastic layer is made to gradually decrease in a direction toward the end portion of the elastic layer.

[Patent Document 1]

Tokkai 2004-61700 (Japanese Non-Examined Patent Publication)

[Patent Document 2]

Tokkai 2001-265146 (Japanese Non-Examined Patent Publication)

[Patent Document 3]

Tokkai 2001-215833 (Japanese Non-Examined Patent Publication)

[Patent Document 4]

Tokkaihei 11-242403 (Japanese Non-Examined Patent Publication)

[Patent Document 5]

Tokkai 2001-134123 (Japanese Non-Examined Patent Publication)

As for the pair of pressing rollers on each of which the rubber elastic layer is applied, both pressing rollers are heated up to about 180° C., and the pair of pressing rollers forms the pressure nip section caused by the pressing force generated between them, and further, at least one of the pressing rollers is driven to rotate, in order to conduct the fixing operation for the transfer material, which holds the unfixed toner image on it, either directly or through the fixing belt placed between the pressing rollers. Although a heat resistant resin material is employed for the elastic layer and the elastic layer is formed in a cylindrical shape on the metal axis through a molding process, the repeated load incurred during a long operating term would cause a fatigue of the elastic layer, resulting in partial cracks or a failure of the elastic layer. Accordingly, it becomes difficult to create a uniform pressing state at the pressure nip section for a long time.

SUMMARY OF THE INVENTION

To overcome the abovementioned issues in conventional image forming apparatus, it is an object of the present invention to provide an image forming apparatus, in which a lifetime of the fixing device is extended by extending the lifetime of the low hardness pressing roller, a number of durable printing times of which tends to be shortened.

Accordingly, to overcome the cited issues, the abovementioned object of the present invention can be attained by fixing devices and image forming apparatus described as follow.

(1) A fixing device equipped in an image forming apparatus, which employs an electro-photographic method for forming an image on a transfer material, the fixing device comprising: a first roller having a first elastic layer formed in a cylindrical shape on an outer surface of the first roller; and a second roller having a second elastic layer formed in a cylindrical shape on an outer surface of the second roller, and forming a nip section between the first elastic layer and the second elastic layer; wherein a hardness of the second elastic layer is higher than that of the first elastic layer; and wherein a longitudinal length of the first elastic layer in an axial direction of the first roller is greater than that of the second elastic layer in an axial direction of the second roller.

(2) The fixing device of item 1, wherein the hardness is measured as Asker C hardness.

(3) The fixing device of item 1, wherein a thickness of the first elastic layer is greater than that of the second elastic layer.

(4) The fixing device of item 1, further comprising: a heating roller to generate heat; and a belt that is threaded on the first roller and the heating roller so as to transmit the heat generated by the heating roller to the nip section.

(5) The fixing device of item 4, wherein the image forming apparatus is a color image forming apparatus.

(6) The fixing device of item 1, wherein the second roller is provided with a third elastic layer formed on an outer surface of the second elastic layer; and wherein a hardness of the third elastic layer is lower than that of the first elastic layer.

(7) The fixing device of item 1, wherein each of the first elastic layer and the second elastic layer includes either a silicon sponge material or a silicon rubber material as a main ingredient.

(8) The fixing device of item 1, wherein the first elastic layer has a non-contacting area, in which the second elastic layer, disposed opposite to the first elastic layer, does not contact the first elastic layer, at each of both end portions in an axial direction.

(9) A fixing device equipped in an image forming apparatus, which employs an electro-photographic method for forming an image on a transfer material, the fixing device comprising: a first roller having a first elastic layer formed in a cylindrical shape on an outer surface of the first roller; a heating roller to generate heat; a belt that is threaded on the first roller and the heating roller, so that the belt is heated with the heat generated by the heating roller; and a second roller having a second elastic layer formed in a cylindrical shape on an outer surface of the second roller; wherein the belt is nipped between the first elastic layer and the second elastic layer, so as to form a nip section between the belt and the second elastic layer; and wherein a longitudinal length of the first elastic layer in an axial direction of the first roller is greater than that of the second elastic layer in an axial direction of the second roller.

(10) The fixing device of item 9, wherein a hardness of the second elastic layer is higher than that of the first elastic layer.

(11) The fixing device of item 9, wherein a thickness of the first elastic layer is greater than that of the second elastic layer.

(12) The fixing device of item 9, wherein the image forming apparatus is a color image forming apparatus.

(13) The fixing device of item 9, wherein each of the first elastic layer and the second elastic layer includes either a silicon sponge material or a silicon rubber material as a main ingredient.

(14) A fixing device equipped in an image forming apparatus, which employs an electro-photographic method for forming an image on a transfer material, the fixing device comprising: a first roller having a first elastic layer formed in a cylindrical shape on an outer surface of the first roller; a heat supplying member to supply heat onto the first roller from an outside of the first roller; and a second roller having a second elastic layer formed in a cylindrical shape on an outer surface of the second roller, and forming a nip section is formed between the first elastic layer and the second elastic layer; and wherein a longitudinal length of the first elastic layer in an axial direction of the first roller is greater than that of the second elastic layer in an axial direction of the second roller.

(15) The fixing device of item 14, wherein a hardness of the second elastic layer is higher than that of the first elastic layer.

(16) The fixing device of item 14, wherein a thickness of the first elastic layer is greater than that of the second elastic layer.

(17) The fixing device of item 14, wherein the image forming apparatus is a color image forming apparatus.

(18) The fixing device of item 14, wherein the heat supplying member includes: a heating roller to generate heat; and a belt that is threaded on the first roller and the heating roller so as to transmit the heat generated by the heating roller to the first roller.

(19) The fixing device of item 14, wherein each of the first elastic layer and the second elastic layer includes either a silicon sponge material or a silicon rubber material as a main ingredient.

(20) An image forming apparatus, which employs an electro-photographic method for forming an image on a transfer material, the image forming apparatus comprising: an image forming section to form an unfixed toner image on the transfer material through consecutive processes based on the electro-photographic method; and a fixing device to fix the unfixed toner image with heat and pressure onto the transfer material in order to output the transfer material with the image fixed on the transfer material; wherein the fixing device includes: a first roller having a first elastic layer formed in a cylindrical shape on an outer surface of the first roller; a heating roller to generate heat; a belt that is threaded on the first roller and the heating roller, so that the belt is heated with the heat generated by the heating roller; and a second roller having a second elastic layer formed in a cylindrical shape on an outer surface of the second roller; wherein the belt is nipped between the first elastic layer and the second elastic layer, so as to form a nip section between the belt and the second elastic layer; and wherein a longitudinal length of the first elastic layer in an axial direction of the first roller is greater than that of the second elastic layer in an axial direction of the second roller.

(21) The image forming apparatus of item 20, wherein a hardness of the second elastic layer is higher than that of the first elastic layer.

(22) The image forming apparatus of item 20, wherein a thickness of the first elastic layer is greater than that of the second elastic layer.

(23) The image forming apparatus of item 20, wherein the image forming apparatus is a color image forming apparatus.

(24) The image forming apparatus of item 20, wherein each of the first elastic layer and the second elastic layer includes either a silicon sponge material or a silicon rubber material as a main ingredient.

Further, to overcome the abovementioned issues, other image forming apparatus, embodied in the present invention, will be described as follow:

(25) An image forming apparatus, characterized in that, in the image forming apparatus that is provided with a fixing unit, which comprises a pair of pressing rollers and a pressure nip section formed by the pair of pressing rollers so as to apply heat and pressure onto a transfer material holding an unfixed toner image at the pressure nip section, each of the pressing rollers is an elastic roller onto which a rubber elastic layer, formed in a cylindrical shape around the rotating axis, is fixedly adhered, and when a hardness of the rubber elastic layer, formed in a cylindrical shape, is expressed in Asker C indication, a length of a fixedly adhered portion of the rubber elastic layer of the pressing roller in a rotating axial direction, the hardness of which is lower than the other, is longer than that of a fixedly adhered portion of the rubber elastic layer of the pressing roller in a rotating axial direction, the hardness of which is higher than the other.

(26) The image forming apparatus recited in item 25, characterized in that the image forming apparatus is provided with a belt member, which is nipped with the unfixed toner image residing on the transfer material at the pressure nip section.

(27) The image forming apparatus recited in item 26, characterized in that the pressing roller, the hardness of which is higher than the other, contacts the unfixed toner image of the belt member at the pressure nip section, and the pressing roller, the hardness of which is lower than the other, is disposed opposite the pressing roller that contacts the unfixed toner image of the belt member.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

An embodiment of the present invention will be detailed in the following. Incidentally, the scope of the present invention and technical terms recited in the claims are not limited to the descriptions in the present specification. Further, the decisive explanations for the embodiment of the present invention described in the following are merely intended to indicate a best mode of the present invention. Accordingly, the meaning of the terms and the technical scope of the present invention are not limited to such the decisive explanations.

Figure 1:
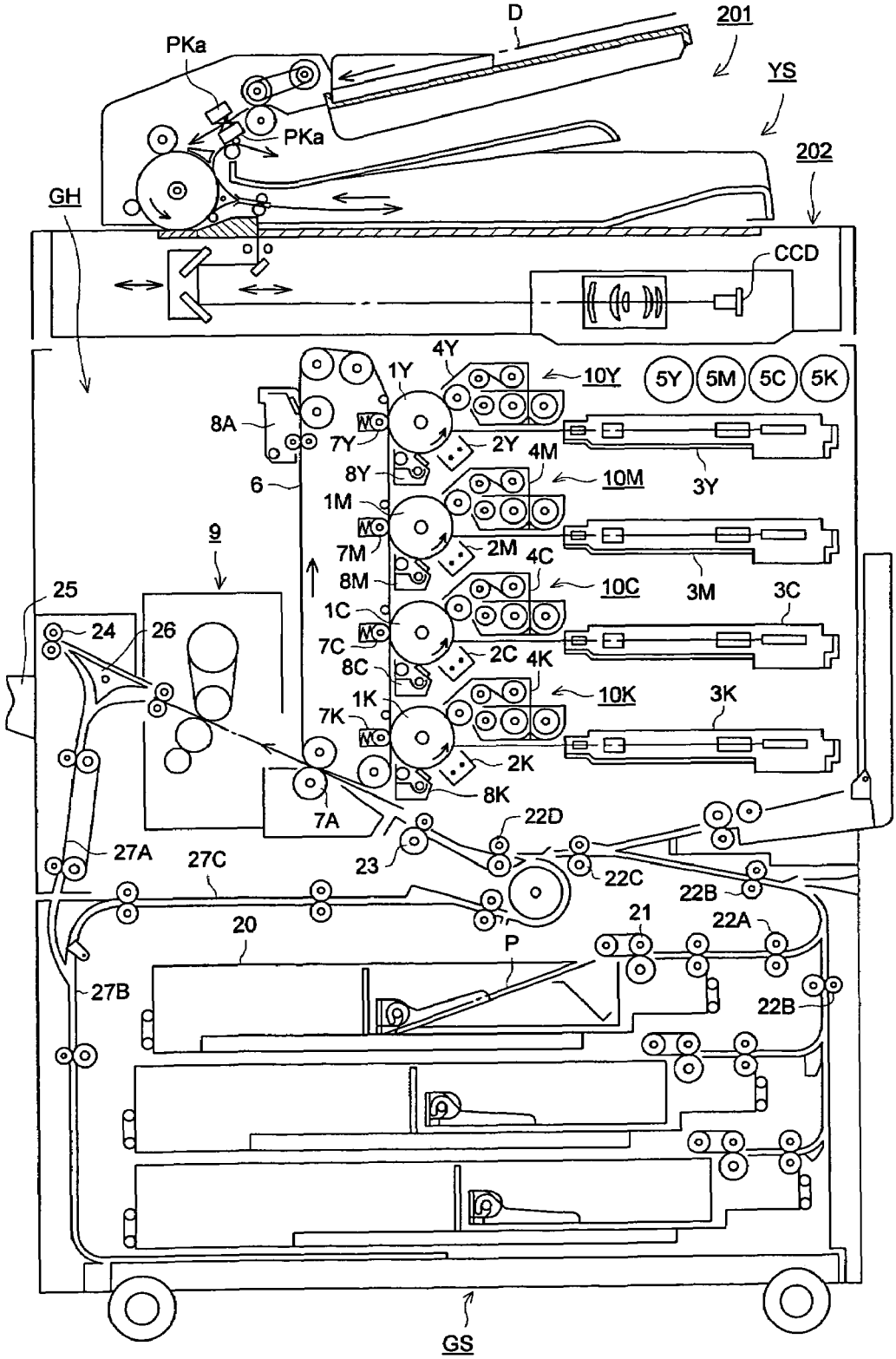
FIG. 1 is a schematic diagram of an image forming apparatus equipped with a fixing apparatus.

Referring to FIG. 1, an image forming apparatus provided with a belt fixing device will be detailed in the following.

As shown in FIG. 1, an image forming apparatus proper GH and an image reading apparatus YS constitute an image forming apparatus GS.

The image forming apparatus proper, known as a tandem-type image forming apparatus, includes a plurality of image forming sections 10Y, 10M, 10C, 10K, an intermediate transfer belt 6, a paper feeding section and a fixing device 17.

The image-reading apparatus YS, including an automatic document feeder 201 and a document image scanning-and-exposing device 202, is disposed at an upper portion of the image forming apparatus proper GH. A conveying mechanism conveys a document D put on a document tray of the automatic document feeder 201, so that an optical system of the document image scanning-and-exposing device 202 scans and exposes a light beam onto images residing on either one side or both sides of the document to read the images by means of a line image sensor CCD. At this time, the document D conveyed from the document tray passes through a glossiness level detecting sensor Pka, serving as a glossiness level selecting unit, to determine a glossiness of the document image, whether the document image is monochrome or color image and whether or not the document image is duplex image.

In the image processing section, various kinds of image processing, such as an analogue processing, an analogue to digital conversion processing, a shading processing, an image compression processing, etc., are applied to analogue signals acquired through opt-electronic converting actions performed in the line image sensor CCD, and then, processed image data are temporarily stored in a storage device so as to transmit them to an image writing section 3Y, 3M, 3C, 3K (serving as an exposing unit).

The image forming section 10Y for forming an image of color Y (Yellow) includes a charging device 2Y, an exposing device 3Y, a developing device 4Y and a cleaning device 8Y, which are disposed around a photoreceptor drum 1Y serving as a image bearing member. The image forming section 10M for forming an image of color M (Magenta) includes a charging device 2M, an exposing device 3M, a developing device 4M and a cleaning device 8M, which are disposed around a photoreceptor drum 1M serving as a image bearing member. The image forming section 10C for forming an image of color C (Cyan) includes a charging device 2C, an exposing device 3C, a developing device 4C and a cleaning device 8C, which are disposed around a photoreceptor drum 1C serving as a image bearing member. The image forming section 10K for forming an image of color K (Black) includes a charging device 2K, an exposing device 3K, a developing device 4K and a cleaning device 8K, which are disposed around a photoreceptor drum 1K serving as a image bearing member. A combination of the charging device 2Y and the exposing device 3Y, the charging device 2M and the exposing device 3M, the charging device 2C and the exposing device 3C, or the charging device 2K and the exposing device 3K, constitutes a latent image forming section.

Each of the developing device 4Y, the developing device 4M, the developing device 4C and the developing device 4K internally includes two component developer constituted by fine toner particles and carriers, corresponding to each of colors Y (Yellow), M (magenta), C (Cyan) and K (Black).

The intermediate transfer belt 6 is threaded on a plurality of rollers so as to rotate around them.

The unicolor toner images, each of which is respectively formed by each of the image forming sections 10Y, 10M, 10C, 10K, are sequentially transferred onto the intermediate transfer belt 6 by transferring devices 7Y, 7M, 7C, 7K, in such a manner that the unicolor toner images overlap with each other so as to form a synthesized full color toner image (a primary transferring operation). A recording paper P, serving as a transfer material and accommodated in a paper feeding cassette 20, is conveyed to a transferring device 7A through paper feeding rollers 22A, 22B, 22C, and a registration roller 23, by a paper feeding device 21. At the transferring device 7A, the full color toner image formed on the intermediate transfer belt 6 is transferred onto the recording paper P (a secondary transferring operation). The recording paper P, on which the full color toner image is transferred, is nipped at the pressure nip section N formed in a fixing device 9. At the pressure nip section N, heat and pressure are applied to the recording paper P so as to fix the full color toner image (or a toner image) onto the recording paper P. Then, a pair of ejecting rollers 24, located at a side of an ejecting path, nips and ejects the recording paper P so as to put it onto an ejecting tray 25 disposed outside the apparatus.

In the duplex image forming mode, at first, an unfixed toner image (such as, the unfixed full color toner image or the like) is formed on an obverse side of the recording paper P. Then, a branching member 26 branches the recording paper P, having a fixed toner image and outputted from fixing device 9, into a circular conveying path 27A from the sheet ejecting path so as to introduce the recording paper P into a reversible conveying path 27B serving as a paper re-feeding mechanism. The recording paper P, both sides of which are reversed relative to each other by the reversible conveying path 27B, passes through a paper re-feeding path 27C and reenter the main path at the position of the paper feeding rollers 22D. The recording paper P, conveyed through the circular conveying path 27A, the reversible conveying path 27B and the paper re-feeding path 27C, is again conveyed to the transferring device 7A, serving as a secondary transferring unit, by the registration roller 23 so as to transfer an unfixed toner image (such as, the unfixed full color toner image or the like) onto another side (namely, a reverse side) of the recording paper P at a time. The recording paper P, on reverse side of which the unfixed toner image is transferred, is conveyed into the fixing device 9 to fix the unfixed toner image onto the recording paper P. Then, the pair of ejecting rollers 24, located at the side of an ejecting path, nips and ejects the recording paper P so as to put it onto an ejecting tray 25 disposed outside the apparatus.

On the other hand, after transferring the unfixed toner image onto the recording paper P by means of the transferring device 7A and separating the recording paper P from the intermediate transfer belt 6 by employing a curvature-separating action, a cleaning device 8A removes residual toner residing on the intermediate transfer belt 6.

Next, referring to FIG. 2, the belt-type fixing device, which id employed in the image forming apparatus will be detailed in the following.

The fixing device 9 is constituted by a fixing belt 91 created by forming a metal base material or a heat resistant resin material and silicon rubber into a belt shape, a support pressing roller 92 that supports and rotates the fixing belt 91 so as to conduct the fixing operation with heat and pressure by nipping both the transfer material and the fixing belt 91, an external pressing roller 93 disposed opposite the support pressing roller 92, and a support heating roller 94 that supports and rotates the fixing belt 91 and internally incorporates heater 94*a*. Further, in order to maintain a surface temperature of the external pressing roller 93 at a temperature suitable for the fixing operation, it is applicable that an external heating roller 95, which contacts the outer surface of the external pressing roller 93, is equipped. In the fixing device 9 having the configuration mentioned in the above, the support pressing roller 92 and external pressing roller 93 forms a pressure nip section N.

The support pressing roller 92 is such a soft roller that includes a rotating axial shaft 921 made of a cylindrical metal pipe or metal axial material having a wall thickness in a range of 2-5 mm, and an elastic layer 922 made of silicon sponge having a thickness of 10 mm and fixedly adhered onto the outer surface of the rotating axial shaft 921. The outer diameter of the support pressing roller 92 is set at 45 mm in this embodiment. Further, the hardness of the soft roller, made by fixedly adhering the elastic layer 922 made of silicon sponge onto the rotating axial shaft 921, is Asker C 30° when expressed in the Asker C indication in this embodiment. Incidentally, the Asker C indication conforms with the JISK7312, JISS6050, and is employed for hardness measurements of a flexible rubber, a sponge, etc.

The external pressing roller 93 is such a soft roller that includes a rotating axial shaft 931 made of a cylindrical metal pipe having a wall thickness in a range of 2-5 mm, an elastic layer 932 made of silicon rubber having a thickness of 3 mm and fixedly adhered onto the outer surface of the rotating axial shaft 921, and a PFA (Perfluoroalkoxy) tube covering over the outer surface of elastic layer 932 so as to serve as a separation layer. The outer diameter of the external pressing roller 93 is set at 50 mm in this embodiment. Further, the hardness of the soft roller, made by fixedly adhering the elastic layer 932 made of silicon rubber onto the rotating axial shaft 931, is Asker C 65° when expressed in the Asker C indication in this embodiment.

Since the material employed for the elastic layer 922 of the support pressing roller 92 is softer than that employed for the elastic layer 932 of the external pressing roller 93 and the thickness of the elastic layer 922 is thicker than that of elastic layer 932, the support pressing roller 92 is mainly deformed at the pressure nip section N so as to maintain the press-contacting condition between them.

The fixing belt 91, threaded on the support pressing roller 92, is an endless belt that includes a polyimide base, thickness of which is 70 μm, a silicon rubber layer, thickness of which is 200 μm, formed on the outer surface of the polyimide base, and a PFA (Perfluoroalkoxy) tube layer covering over the outer surface of the silicon rubber layer. The diameter of the endless belt is 80 mm in this embodiment. Further, the fixing belt 91, also threaded on the support heating roller 94, is heated by the heater 94*a* through the heat transmitting action of the heating roller.

The support heating roller 94 is such a roller that includes an aluminum core metal having a wall thickness of 2 mm and a fluorine resin layer formed on the outer surface of the aluminum core metal. The outer diameter of the support heating roller 94 is 50 mm. Further, collar members, serving as stoppers for restricting a position of the fixing belt, are disposed at both end portions of the roller, so that the fixing belt does not slide in the axial direction.

The width of the fixing belt is set at 360 mm, while the distance between the collar members for restricting the position of the fixing belt is set at 362 mm. Accordingly, the fixing belt is movable within this range.

If the end portion of the pressure nip section N resides within a range of the belt width, the end portion of the fixing belt 91 would be considerably deformed, resulting in a wrinkled break down. To avoid this break down, the width of the elastic layer 932 of the external pressing roller 93 (namely, the length of adhesive section of the elastic layer 932 in a direction of its rotating axis) is set at 366 mm. In this embodiment, the width of the support pressing roller 92, which has a lower softness value in term of Asker C indication, (namely, the length of adhesive section of the elastic layer 922 in a direction of its rotating axis) is set at 382 mm, which is longer than that of the external pressing roller 93. Accordingly, at the each of both ends of the pressure nip section N, the length of the elastic layer 922 is longer than that of the elastic layer 932 by L=8 mm (refer to FIG. 3(*b*)).

By employing the abovementioned structure, stresses concentrated at the end portion of the elastic layer 922, which is adhered onto the rotating axial shaft 921 of the support pressing roller 92, are dispersed in a range of the length L, resulting in an improvement of the durability.

Figure 3:
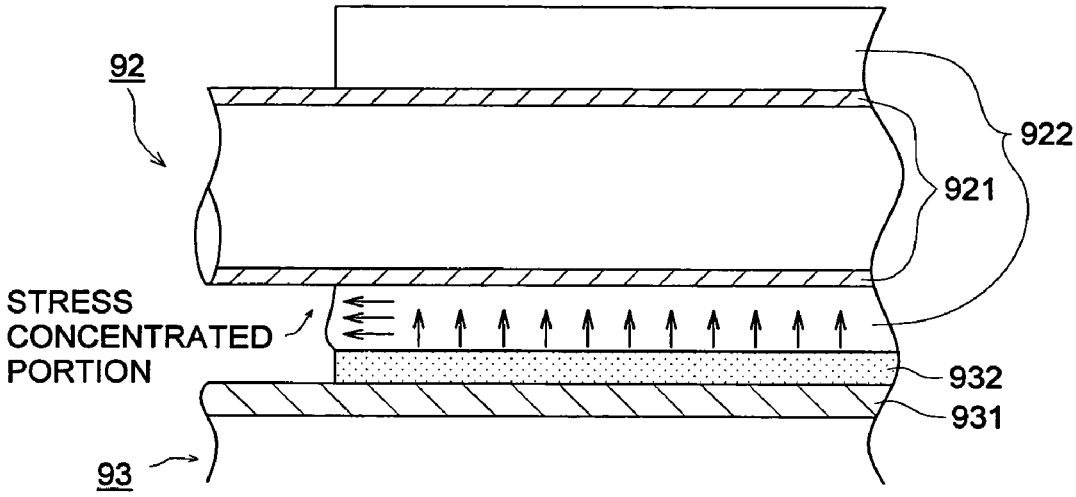
FIG. 3(*a*) and FIG. 3(*b*) are explanatory schematic diagrams indicating states of stress concentration generated at an end portion of an elastic layer of a support pressing roller.
Figure 3:
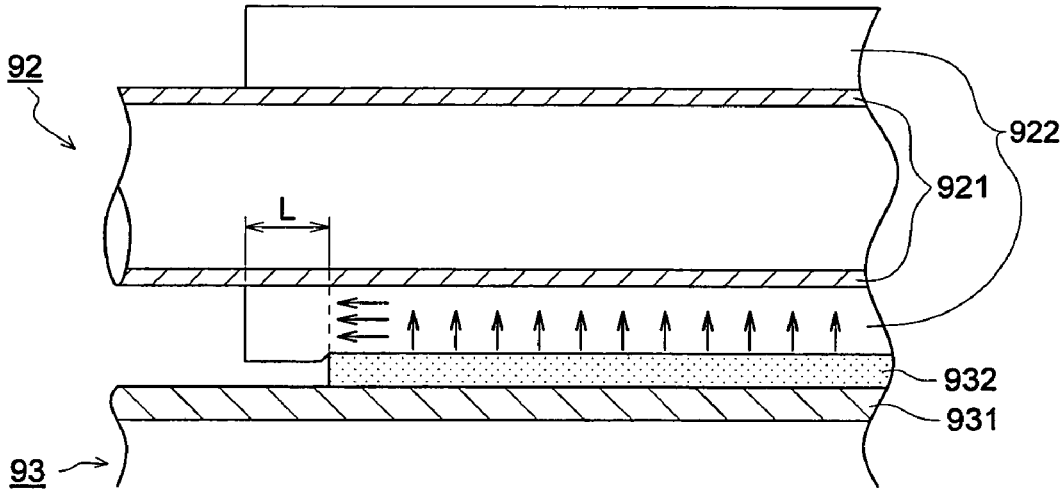

FIG. 3(*a*) and FIG. 3(*b*) are explanatory schematic diagrams indicating states of stress concentration generated at the end portion of the elastic layer 922 of the support pressing roller 92. FIG. 3(*a*) shows a state of stresses (indicated by arrows) when the length of the elastic layer 922 of the support pressing roller 92 is equal to or shorter than that of the elastic layer 932 of the external pressing roller 93. At an end portion P of the elastic layer 922 adhered onto the rotating axial shaft 921, since the end portion P is in such a fixedly adhered state that it can not be deformed by stresses generated in its shearing direction, the stresses exerted in its shearing direction is concentrated at the end portion P, and therefore, the failure of the elastic layer 922 is to be generate from the stress concentrated portion at the end portion P due to the cyclic loading caused by the stress concentration.

FIG. 3(*b*) shows a state of stresses (indicated by arrows) when the length of the adhered portion of the elastic layer 922 of the support pressing roller 92 is longer than that of the elastic layer 932 by length L=8 mm. By extending the length of the adhered portion of the elastic layer 922 toward its outer direction by length L, compared to that of the end portion P (namely, the stress concentrated portion) shown in FIG. 3(*a*), the stresses generated in its shearing direction and concentrated at the end portion P are dispersed in the length L. Accordingly, it becomes possible to eliminate the failure of the elastic layer 922 caused by the stress concentration occurring at the end portion P, resulting in an increase of a number of durable printing times.

In the present embodiment, to acquire a satisfactory width of the pressure nip section N when the outputting rate of the image forming apparatus is set at 65 papers per minute, such the roller configuration mentioned in the above is employed. On the other hand, when the elastic layer 932 of the external pressing roller 93 is made to be further softer (to indicate a low hardness value expressed in the Asker C indication) so as to acquire a still wider width of the pressure nip section N than that mentioned in the above, the length L, being a differential value between the adhered portion of the elastic layer 922 of the support pressing roller 92 and one side length of the adhered portion of the elastic layer 932, is made to be gradually reduced. Further, when the elastic layer 932 is made to have substantially the same hardness as that of the support pressing roller 92 (the same hardness value expressed in the Asker C indication), it is most superior setting in the balancing point of view to set the length L at zero (namely, set the both total longitudinal lengths at the same length).

By selecting the differential length L, corresponding to the hardness difference, expressed in the Asker C indication, between the elastic layers formed in a cylindrical shape on the pair of the pressing rollers, it is possible to select such a differential length L that makes the life of the pair of the pressing rollers longer than ever. However, since the relationship between the hardness difference expressed in the Asker C indication and the differential length L varies depending on the material of the elastic layer, the outer diameter of the roller, the fixing load, the working temperature conditions, etc., such the relationship is experimentally found.

REFERENCE EXAMPLE

Figure 2:
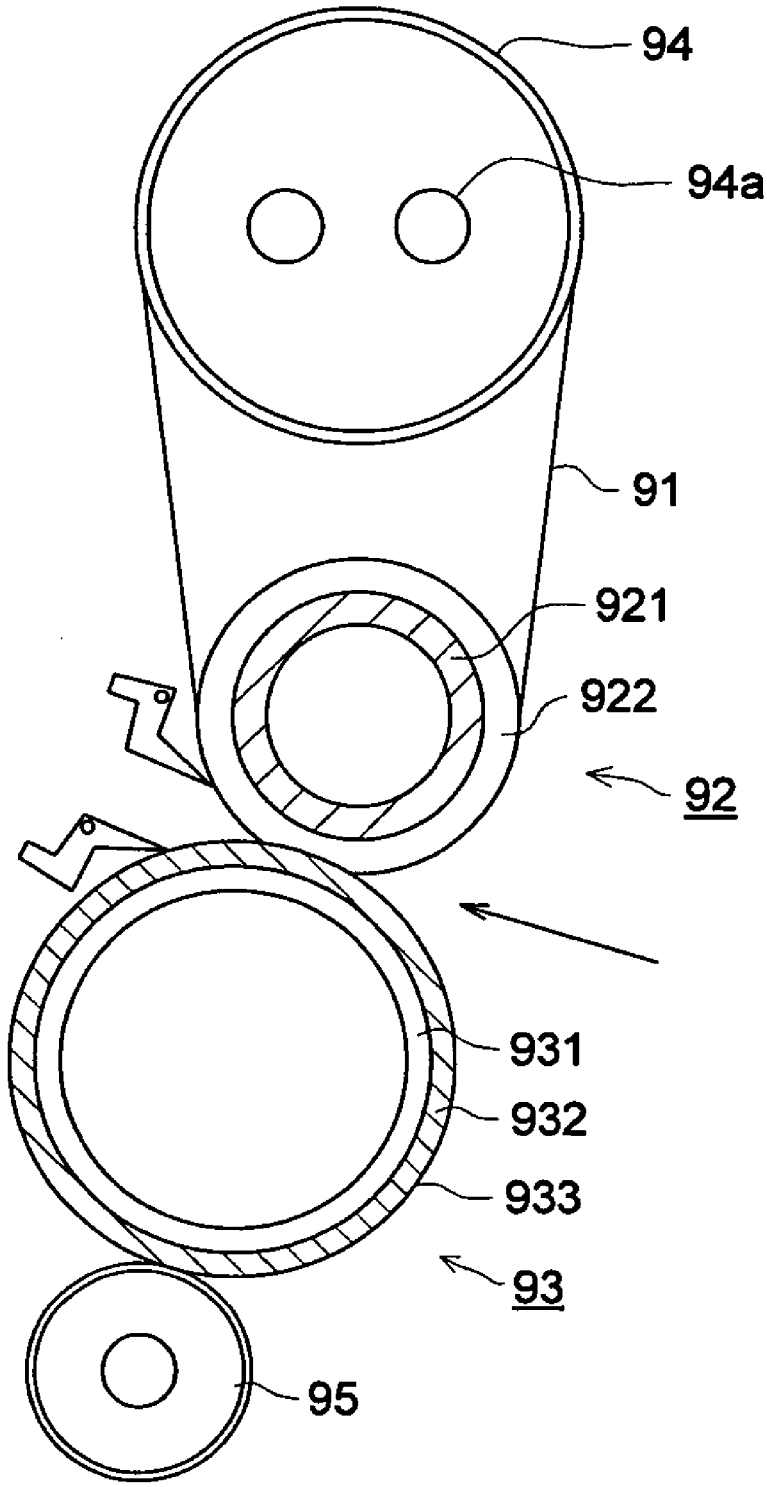
FIG. 2 is a cross sectional schematic diagram, showing a configuration of a belt-type fixing device.
Figure 4:
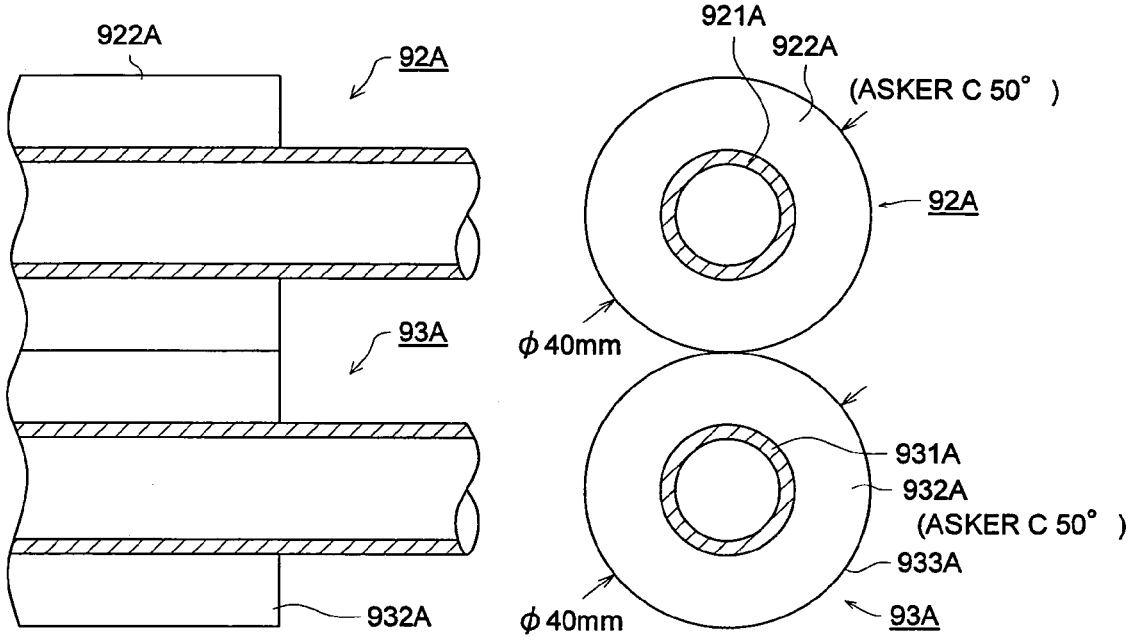
FIG. 4 is a cross sectional schematic diagram, showing a configuration of a support pressing roller and a external pressing roller, employed in reference example.

The present inventors have created various kinds of combinations of the support pressing roller 92 and the external pressing roller 93 to be employed for the fixing device 9 shown in FIG. 1 and FIG. 2 in order to conducts various tests. As aforementioned, the test conditions for the reference example are as follow.

load between the pressing rollers: 900 N, length of the elastic layer of the external pressing roller: 366 mm, belt temperature at the pressure nip section: 180° C., outputting rate: 65 papers (A4) per minutes at the belt velocity of 300 mm/s Cross sectional structures of a support pressing roller 92A and an external pressing roller 93A shown in FIG. 4 are the same as those of the support pressing roller 92 and the external pressing roller 93, except that the external pressing roller 93A has a PFA tube layer 933A, thickness of which is 30 μm, on its outer surface. The dimensions of rotating axial shafts 921A and 931A are the same relative to each other. Elastic layers made of a silicon rubber material are formed in a cylindrical shape in such a manner that the elastic layers are fixedly adhered onto the outer surfaces of the rotating axial shafts 921A and 931A. The outer diameters of them are established at 40 mm. The hardness of both rollers, in which such the elastic layers are fixedly adhered onto the outer surfaces of the rotating axial shafts, was Asker C 50°.

In the reference example, since the lengths of the elastic layers 922A and 932A, fixedly adhered onto the outer surfaces of the rotating axial shafts 921A and 931A, are made to be the same, both of them exhibited usable durability of more than 300,000 prints without determining the life of the pair of the rollers due to a breakdown of any one of them prior to that of the other one.

Embodiment 1

Figure 5:
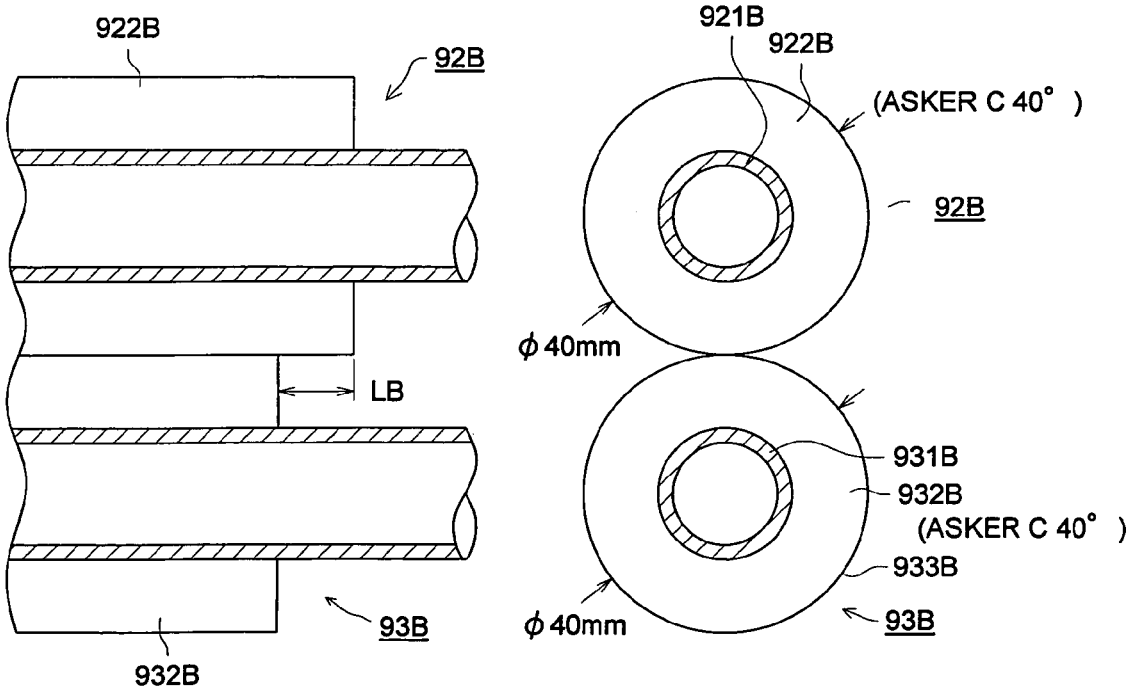
FIG. 5 is a cross sectional schematic diagram, showing a configuration of a support pressing roller and a external pressing roller, employed in embodiment 1.

In the embodiment 1 shown in FIG. 5, although cross sectional shapes of a support pressing roller 92B and a external pressing roller 93B are the same as those of the support pressing roller 92A and the external pressing roller 93A, respectively, the width of the pressure nip section is established at a value wider than that of embodiment 1. Further, to improve the separation efficiency, a silicon rubber layer, which is softer than that employed for the elastic layer 922A of the support pressing roller 92A, is employed for the elastic layer 922B of the support pressing roller 92A. The hardness of the roller, having the elastic layer 922B fixedly adhered onto the outer surface of the rotating axial shaft 921B, was set at Asker C 40°. On the other hand, the hardness of the other roller, having the elastic layer 932B fixedly adhered onto the outer surface of the rotating axial shaft 931B, was set at Asker C 50°. Accordingly, the length of the elastic layer 922B, fixedly adhered onto the rotating axial shaft 921B of the support pressing roller 92B, is set at such a length that is longer than that of the elastic layer 932B, fixedly adhered onto the rotating axial shaft 931B of the support pressing roller 93B, by 2 LB, to conduct the test.

In the embodiment 1, by setting the length LB at LB≧5 mm for each of both sides of the elastic layer 922B, the life of the pair of the support pressing roller 92B and the external pressing roller 93B can be extended up to 300,000 prints as the usable durability, compared to the 80,000 prints that was the usable durability of the support pressing roller 92B when the lengths of the both rollers were set at the same length as each other. Accordingly, it was found that, when the combination of the support pressing roller 92B and the external pressing roller 93B is employed in the fixing device 9, a number of durable printing times of the pair of the pressing rollers increases, compared to the conventional configuration of such the rollers.

Embodiment 2

Figure 6:
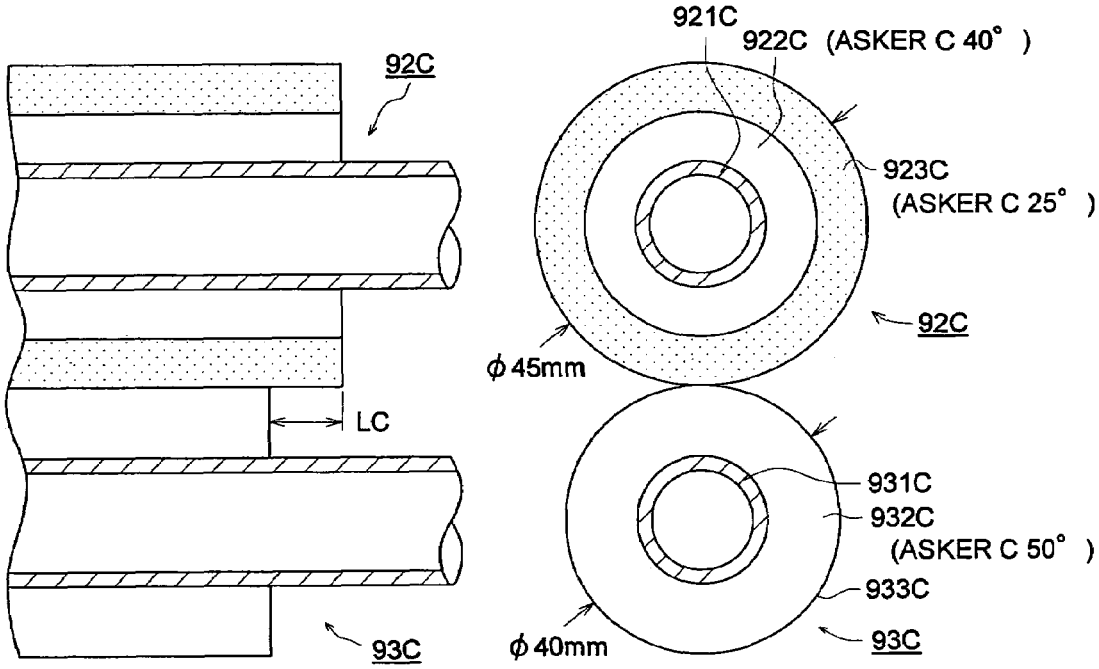
FIG. 6 is a cross sectional schematic diagram, showing a configuration of a support pressing roller and a external pressing roller, employed in embodiment 2.

In the embodiment 2 shown in FIG. 6, a plurality of elastic layers are provided on a support pressing roller 92C, so as to make the hardness of the roller further softer than that in the embodiment 1. Further, the width of the pressure nip section is established at a wide value, so as to improve the separation efficiency of the transfer material after completing the fixing operation.

In the support pressing roller 92C, an elastic layer 922C, made of a silicon rubber layer, is formed in a cylindrical shape in such a manner that the silicon rubber layer is fixedly adhered onto the outer surface of a rotating axial shaft 921C made of a metal pipe, and further, an elastic layer 923C, made of a silicon sponge layer, is formed in a cylindrical shape in such a manner that the silicon sponge layer is fixedly adhered onto the outer surface of the elastic layer 922C. The outer diameter of the support pressing roller 92C is set at 45 mm.

The hardness of the elastic layer 922C, fixedly adhered onto the rotating axial shaft 921C before forming the silicon sponge layer on it, was set at Asker C 40°, while the hardness of the roller, provided with the elastic layer 923C onto the outer surface of the elastic layer 922C, was set at Asker C 25°.

On the other hand, in the external pressing roller 93C, an elastic layer 932C, made of a silicon rubber layer, is formed in a cylindrical shape in such a manner that the silicon rubber layer is fixedly adhered onto the outer surface of a rotating axial shaft 931C, and further, an PFA tube layer 933C is provided on the outer surface of the elastic layer 932C. The outer diameter of the external pressing roller 93C is set at 40 mm.

The hardness of the elastic layer 932C, fixedly adhered onto the rotating axial shaft 931C, was set at Asker C 50°.

In the embodiment 2, since a hardness of the roller, having the elastic layer 922C fixedly adhered onto the outer surface of the rotating axial shaft 921C of the support pressing roller 92C, is softer than a hardness of the other roller, having the elastic layer 932C fixedly adhered onto the outer surface of the rotating axial shaft 931C of the external pressing roller 93C, the length of the elastic layer 922C, fixedly adhered onto the rotating axial shaft 921C of the support pressing roller 92C, is set at such a length that is longer than that of the elastic layer 932C, fixedly adhered onto the rotating axial shaft 931C of the support pressing roller 93C, by 2 LC, to conduct the test.

In the embodiment 2, by setting the length LC at LC≧7 mm for each of both sides of the elastic layer 932C, the life of the pair of support pressing roller 92C and external pressing roller 93C can be extended up to 300,000 prints as the usable durability, compared to the 50,000 prints that was the usable durability of the support pressing roller 92C when the lengths of the both rollers were set at the same length as each other. Accordingly, it was found that, when the combination of the support pressing roller 92C and the external pressing roller 93C is employed in the fixing device 9, the usable durability of them is considerably improved, compared to the conventional configuration in which the lengths of them are the same.

Embodiment 3

Figure 7:
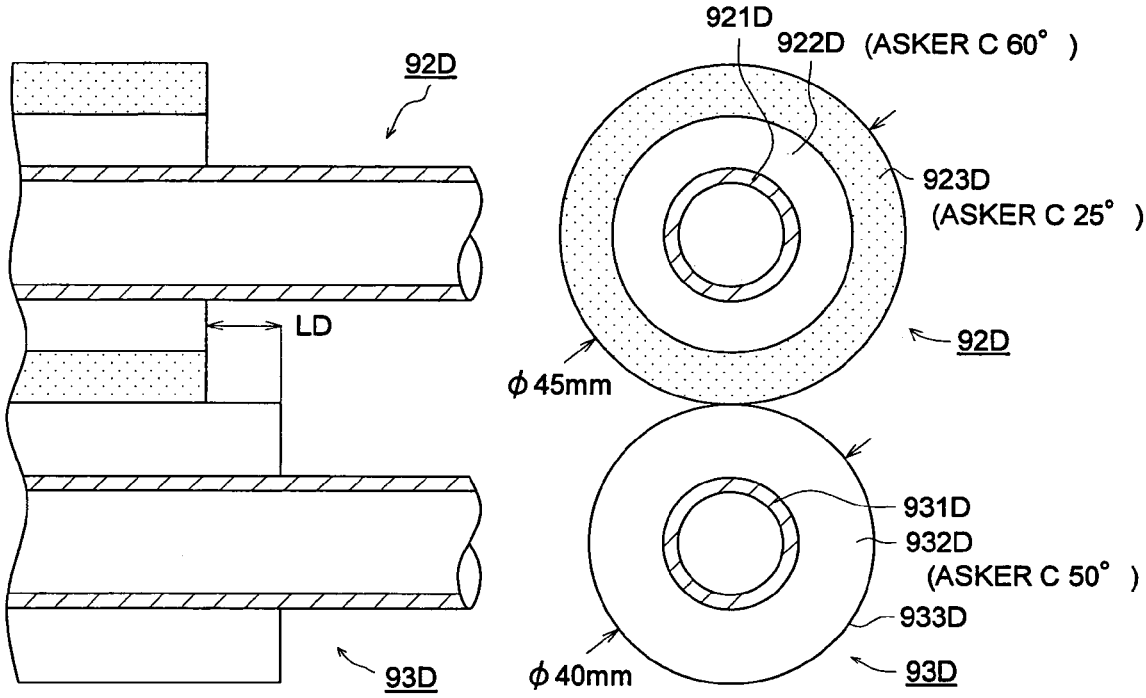
FIG. 7 is a cross sectional schematic diagram, showing a configuration of a support pressing roller and a external pressing roller, employed in embodiment 3.

The present inventors have created a combination of a support pressing roller 92D and an external pressing roller 93D shown in FIG. 7 (right) to conduct a test.

In the support pressing roller 92D, an elastic layer 922D, made of a silicon rubber layer that is harder than that in the embodiment 1, is formed in a cylindrical shape in such a manner that the silicon rubber layer is fixedly adhered onto the outer surface of a rotating axial shaft 921D made of a metal pipe, and further, an elastic layer 923D, made of a silicon sponge layer, is formed in a cylindrical shape in such a manner that the silicon sponge layer is fixedly adhered onto the outer surface of the elastic layer 922D. The outer diameter of the support pressing roller 92D is set at 45 mm.

The hardness of the elastic layer 922D, fixedly adhered onto the rotating axial shaft 921D before forming the silicon sponge layer on it, was set at Asker C 60°, while the hardness of the roller, provided with the elastic layer 923D onto the outer surface of the elastic layer 922D, was set at Asker C 25°.

On the other hand, with respect to the external pressing roller 93D, its configuration and material are the same as those of the external pressing roller 93C. Accordingly, the hardness of the elastic layer 932D, fixedly adhered onto the rotating axial shaft 931D, was set at Asker C 50°.

When the combination of the support pressing roller 92D and the external pressing roller 93D, both of which have fixedly adhered portions of the same length, was employed in the fixing device 9 for practical use, a failure occurring at an end portion of the external pressing roller 93D was recognized after about 60,000 times of printing operations had been completed.

To overcome such the failure, as shown in FIG. 7 (left), the length of the adhered portion of the external pressing roller 93D was set at such a length that was longer than that of the support pressing roller 92D by 2 LD to conduct a test. As a result of the test, it was found that, when the length LD was set at LD≧5 mm for each of both sides of the external pressing roller 93D, the usable durability of the combination of the support pressing roller 92D and the external pressing roller 93D was apparently improved and was extended to more than 30,000 prints, compared to the conventional configuration in which the lengths of them were the same.

According to the abovementioned embodiments the following effects can be attained.

Since the longitudinal length of the first elastic layer in the axial direction of the first roller is greater than that of the second elastic layer in an axial direction of the second roller and the hardness of the second elastic layer is higher than that of the first elastic layer, it becomes possible to provide an image forming apparatus, in which a lifetime of the fixing device is extended by extending the lifetime of the low hardness pressing roller (namely, the first roller), a number of durable printing times of which tends to be shortened.

When the pair of pressing rollers is applied to the belt-type fixing device, the fixing operation is conducted by employing the belt in a heated state, and only an auxiliary heat source would be employed even if it is requested to equip an additional heat source in the pressing roller. Therefore, it becomes possible to make the elastic layer thicker and softer than ever in the pair of the pressing rollers and further, to attain such an effect that a favorable fixing operation suitable for a color image having a uniform glossiness can be conducted with a good separation efficiency by employing the wider pressure nip section.

Further, by setting the hardness of the pressing roller, which is disposed at the side of the toner image of the transfer material while putting the belt between them, at lower value than that of the other roller disposed opposite, it becomes possible to further emphasize the abovementioned effect.

Disclosed embodiment can be varied by a skilled person without departing from the spirit and scope of the invention.

What is claimed is:

1. A fixing device equipped in an image forming apparatus, which employs an electro-photographic method for forming an image on a transfer material, said fixing device comprising:

a first roller having a first elastic layer formed in a cylindrical shape on an outer surface of said first roller; and a second roller having a second elastic layer formed in a cylindrical shape on an outer surface of said second roller, and forming a nip section between said first elastic layer and said second elastic layer;

wherein a hardness of said second elastic layer is higher than that of said first elastic layer; and wherein a longitudinal length of said first elastic layer in an axial direction of said first roller is greater than that of said second elastic layer in an axial direction of said second roller.

2. The fixing device of claim 1, wherein said hardness is measured as Asker C hardness.

3. The fixing device of claim 1, wherein a thickness of said first elastic layer is greater than that of said second elastic layer.

4. The fixing device of claim 1, further comprising:

a heating roller to generate heat; and a belt that is threaded on said first roller and said heating roller so as to transmit said heat generated by said heating roller to said nip section.

5. The fixing device of claim 4, wherein said image forming apparatus is a color image forming apparatus.

6. The fixing device of claim 1, wherein said second roller is provided with a third elastic layer formed on an outer surface of said second elastic layer; and wherein a hardness of said third elastic layer is lower than that of said first elastic layer.

7. The fixing device of claim 1, wherein each of said first elastic layer and said second elastic layer includes either a silicon sponge material or a silicon rubber material as a main ingredient.

8. The fixing device of claim 1, wherein said first elastic layer has a non-contacting area, in which said second elastic layer, disposed opposite to said first elastic layer, does not contact said first elastic layer, at each of both end portions in an axial direction.

* * * * *